US010927729B1

(12) United States Patent
Read et al.

(10) Patent No.: US 10,927,729 B1
(45) Date of Patent: Feb. 23, 2021

(54) PRE-CONDENSING PCV SYSTEM

(71) Applicants: Iain J Read, Warren, MI (US); Timothy J Sullivan, Oxford, MI (US)

(72) Inventors: Iain J Read, Warren, MI (US); Timothy J Sullivan, Oxford, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 16/580,821

(22) Filed: Sep. 24, 2019

(51) Int. Cl.
*F01M 13/04* (2006.01)
*F02M 35/10* (2006.01)

(52) U.S. Cl.
CPC ..... *F01M 13/04* (2013.01); *F02M 35/10222* (2013.01)

(58) Field of Classification Search
CPC ..... F01M 13/04; F02M 35/10222
See application file for complete search history.

(56) References Cited

U.S. PATENT DOCUMENTS 5,024,203 A * 6/1991 Hill ..... F01M 13/04 123/572
5,586,996 A 12/1996 Manookian, Jr.
6,729,316 B1 5/2004 Knowles
7,543,573 B2 6/2009 Olree
2012/0138030 A1 6/2012 Yang
2014/0116399 A1 5/2014 Ulrey et al.
2016/0123283 A1 5/2016 Newman et al.

FOREIGN PATENT DOCUMENTS

DE 102006018783 A1 * 2/2007 ..... F01M 13/04
KR 100401567 B1 10/2003
WO WO-0023693 A1 * 4/2000 ..... F01M 13/04
WO 2017088343 A1 6/2017

* cited by examiner

*Primary Examiner* — Jacob M Amick
*Assistant Examiner* — Charles Brauch
(74) *Attorney, Agent, or Firm* — Ralph E Smith

(57) ABSTRACT

A positive crankcase ventilation (PCV) system for an internal combustion engine having an air induction system configured to supply air to the includes a PCV line configured to fluidly couple between a crankcase of the engine and the air induction system, a condenser disposed on the PCV line and configured to condense water vapor and fuel vapor contained in blow-by gases received from the crankcase to separate the water vapor and fuel vapor from the blow-by gases and form a water/fuel mixture and a lean blow-by gas, and an oil separator disposed on the PCV line and configured to receive the lean blow-by gas from the condenser and separate oil therefrom to form a filtered blow-by gas for return to the air induction system.

12 Claims, 3 Drawing Sheets

PRE-CONDENSING PCV SYSTEM

FIELD

The present application relates generally to positive crankcase ventilation (PCV) systems for internal combustion engines and, more particularly, to a PCV system with a pre-condenser for an internal combustion engine.

BACKGROUND

Positive crankcase ventilation (PCV) systems are designed to evacuate blow-by gases from a crankcase of an internal combustion engine. These gases are formed of an air/fuel mixture that escapes the combustion chamber by "blowing by" the piston seals. To avoid corrosion and high pressures in the crankcase that can potentially damage the seals and increase pumping work, the blow-by gases must be vented therefrom. This is typically accomplished by returning the blow-by gases to the intake side of the internal combustion engine where the gases are mixed with the air/fuel mixture and subsequently burned. However, because the blow-by gases also typically include a quantity of water and fuel, the size of the PCV system must be increased to accommodate this additional mass per minute. Thus, while current PCV systems do work well for their intended purpose, it is desirable to provide an improved PCV system.

SUMMARY

According to one example aspect of the invention, a positive crankcase ventilation (PCV) system for an internal combustion engine having an air induction system configured to supply air to the engine is provided. In one example configuration, the PCV system includes a PCV line configured to fluidly couple between a crankcase of the engine and the air induction system, a condenser disposed on the PCV line and configured to condense water vapor and fuel vapor contained in blow-by gases received from the crankcase to separate the water vapor and fuel vapor from the blow-by gases and form a water/fuel mixture and a lean blow-by gas, and an oil separator disposed on the PCV line and configured to receive the lean blow-by gas from the condenser and separate oil therefrom to form a filtered blow-by gas for return to the air induction system.

In addition to the foregoing, the described PCV system may include one or more of the following features: wherein the condenser is disposed on the PCV line upstream of the oil separator; a fuel/water separator fluidly coupled to the condenser to receive the water/fuel mixture therefrom, the fuel/water separator configured to separate the water/fuel mixture into fuel and water; wherein the fuel/water separator is fluidly coupled to a vehicle fuel tank to supply the separated fuel thereto; and wherein the condenser comprises a housing defining an inner chamber, a blow-by gas inlet, a condensate outlet, and a blow-by gas outlet.

In addition to the foregoing, the described PCV system may include one or more of the following features: wherein the condenser further comprises a coolant tube configured to fluidly couple to a source of coolant, the coolant tube extending within the inner chamber between a coolant inlet and a coolant outlet, and the coolant tube configured to cool the blow-by gas in the inner chamber and condense the fuel vapor and water vapor contained in the blow-by gas in the inner chamber; wherein the condenser is thermally coupled to a water jacket of the internal combustion engine such that coolant in the water jacket is configured to cool the condenser housing to thereby cool the inner chamber and condense the fuel vapor and water vapor contained in the blow-by gas in the inner chamber; wherein the condenser housing further comprises a plurality of protrusions extending inwardly from the housing into the inner chamber, the plurality of protrusions configured to be cooled by the water jacket coolant to provide a cooled surface area for condensing the fuel vapor and water vapor contained in the blow-by gas in the inner chamber.

In addition to the foregoing, the described PCV system may include one or more of the following features: wherein the oil separator comprises a housing containing a nozzle plate and a separator; wherein the nozzle plate comprises a plurality nozzles formed therein configured to accelerate the blow-by gas as it passes therethrough; and wherein the separator comprises a fleece media and an impactor plate.

According to another example aspect of the invention, a vehicle is provided. In one example configuration, the vehicle includes an internal combustion engine having a crankcase and an air induction system configured to supply air to a combustion chamber and a positive crankcase ventilation (PCV) system. The PCV system includes a PCV line fluidly coupled between the crankcase and the air induction system and configured to vent blow-by gases from the crankcase to the combustion chamber, a condenser disposed on the PCV line and configured to condense water vapor and fuel vapor contained in the blow-by gases received from the crankcase to separate the water vapor and fuel vapor from the blow-by gases and form a water/fuel mixture and a lean blow-by gas that is free or substantially free of the water vapor and fuel vapor, and an oil separator disposed on the PCV line and configured to receive the lean blow-by gas and separate oil therefrom to form a filtered blow-by gas for return to the combustion chamber.

In addition to the foregoing, the described vehicle may include one or more of the following features: wherein the condenser is disposed on the PCV line upstream of the oil separator; a fuel/water separator fluidly coupled to the condenser to receive the water/fuel mixture therefrom, the fuel/water separator configured to separate the water/fuel mixture into fuel and water; and a fuel tank, wherein the fuel/water separator is fluidly coupled to the fuel tank to supply the separated fuel thereto.

In addition to the foregoing, the described vehicle may include one or more of the following features: wherein the condenser comprises a housing defining an inner chamber, a blow-by gas inlet, a condensate outlet, and a blow-by gas outlet; wherein the condenser further comprises a coolant tube configured to fluidly couple to a source of coolant, the coolant tube extending within the inner chamber between a coolant inlet and a coolant outlet, and the coolant tube configured to cool the blow-by gas in the inner chamber and condense the fuel vapor and water vapor contained in the blow-by gas in the inner chamber.

In addition to the foregoing, the described vehicle may include one or more of the following features: wherein the condenser is thermally coupled to a water jacket of the internal combustion engine such that coolant in the water jacket is configured to cool the condenser housing to thereby cool the inner chamber and condense the fuel vapor and water vapor contained in the blow-by gas in the inner chamber; wherein the condenser housing further comprises a plurality of protrusions extending inwardly from the housing into the inner chamber, the plurality of protrusions configured to be cooled by the water jacket coolant to provide a cooled surface area for condensing the fuel vapor and water vapor contained in the blow-by gas in the inner chamber; and wherein the oil separator comprises a housing containing a nozzle plate and a separator, wherein the nozzle plate comprises a plurality nozzles formed therein configured to accelerate the blow-by gas as it passes therethrough, and wherein the separator comprises a fleece media and an impactor plate.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

The present application is directed to a positive crankcase ventilation (PCV) system of an internal combustion engine. During combustion, small leaks occur past the piston rings into the crankcase, which are typically referred to as blow-by gases. These blow-by gases generally include oil, unburned fuel, carbon, and water vapor. Typical PCV systems include a PCV line to vent blow-by gases from the crank case to an oil separator to thereby extract oil from the gases before being recombusted. However, the fuel vapor and water vapor are not extracted due to them being in vapor form. As such, typical PCV systems must manage the additional mass and materials (i.e., fuel and water).

The present disclosure provides a condenser upstream of the oil separator to enable fuel and water to be extracted from the blow-by gases so the PCV system only has to separate oil from the resulting blow-by gases, as intended, since PCV systems are designed to remove liquid oil, not combustion vapors. As such, the oil can be removed from the blow-by gases without overloading the oil separation device(s) with condensate.

Figure 1:
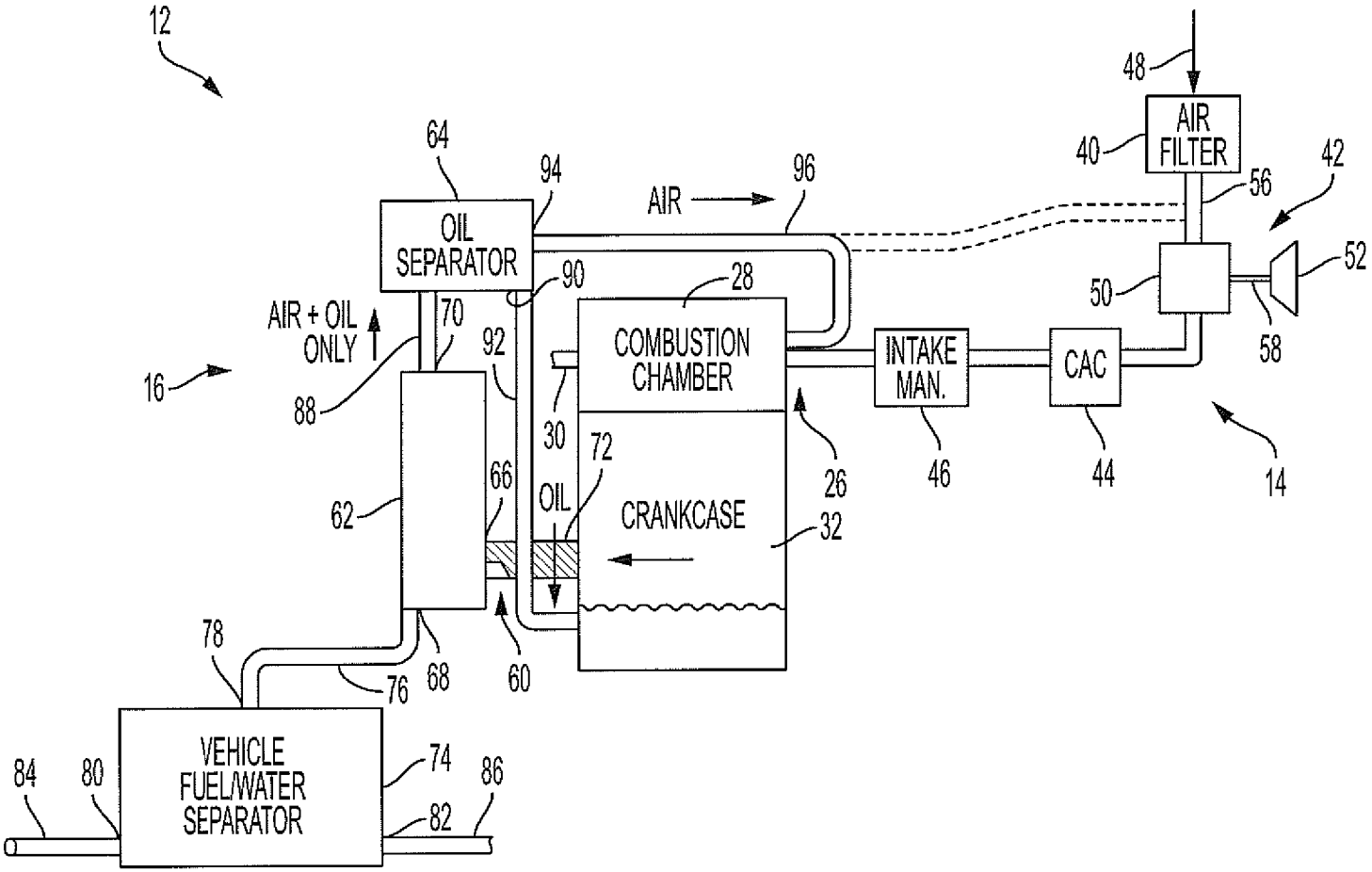
FIG. 1 is a schematic diagram of an example internal combustion engine having a PCV system, in accordance with the principles of the present disclosure.

Referring now to the drawings, FIG. 1 is a schematic illustration of an internal combustion engine 12 that generally includes an air induction system 14 and a PCV system 16. The engine 12 generally includes a cylinder head 20 defining one or more cylinders to each receive a reciprocating piston therein (not shown). An intake port 26 supplies an air/fuel mixture from the air induction system 14 to a combustion chamber 28 within the cylinder. The air/fuel mixture is ignited in the combustion chamber 28 and the resulting exhaust gas is removed from the chamber via an exhaust port 30. During the combustion, a portion of the exhaust gas can blow by the piston into a crankcase 32 of the engine. As described herein in more detail, the PCV system 16 condenses a portion of the blow-by gases and recirculates the remainder of the blow-by gases back to the air induction system 14 for further combustion in the combustion chamber 28.

In one example, the air induction system 14 is a forced air induction system, however it will be appreciated that PCV system 16 may be utilized in various types of air induction systems. In the illustrated example, the forced air induction system 14 generally includes an air filter 40, a turbocharger 42, a charge air cooler 44, and an intake manifold 46. Air enters the vehicle through an air intake 48 and is filtered in the air filter 40 before entering a compressor side 50 of the turbocharger 42. The air is compressed and subsequently cooled in the charge air cooler 44 before being delivered to the intake port 26 via the intake manifold 46. After combustion, the exhaust gas is removed from the combustion chamber 28 through exhaust port 30 before being directed to a turbine side 52 of the turbocharger 42. The exhaust gas drives the turbine side 52, which drives the turbocharger compressor side 50 via a shaft 58, and the exhaust gas is subsequently supplied to a vehicle exhaust aftertreatment system (not shown).

In the example embodiment, the PCV system 16 generally includes a PCV line 60, a condenser 62, and an oil separator 64. It will be appreciated that condenser 62 and oil separator 64 may have any suitable construction that enables condenser 62 and/or oil separator 64 to function as described herein. Some example embodiments are shown in FIGS. 2-5 and described herein in more detail.

With continued reference to FIG. 1, the PCV line 60 is fluidly connected between the crankcase 32 and a clean side air duct 56 (or combustion chamber 28) to vent blow-by gases from the crankcase 32 to the forced air induction system 14. The PCV line 60 includes the condenser 62, which is configured to condense and remove fuel vapor and water vapor from the blow-by gases, and the oil separator 64, which is configured to remove oil from the blow-by gases as they are directed from the crankcase 32 to the forced air induction system 14.

In the example embodiment, the condenser 62 generally includes an inlet 66, a condensate outlet 68, and a gas outlet 70. The condenser 62 is cooled, for example via a coolant, so as to provide one or more relatively cooled components to facilitate condensing of fuel/water vapors. As illustrated, blow-by gases are directed from the crankcase 32 to the condenser inlet 66 via a first PCV line conduit 72. Once in the condenser 62, the fuel vapor and water vapor contained in the blow-by gas are condensed and subsequently directed to a fuel/water separator 74 via condensate outlet 68 and a condensate conduit 76.

In the example embodiment, the fuel/water separator 74 is a conventional vehicle fuel/water separator or filter. In other configurations, the fuel/water separator 74 is a dedicated component of the PCV system 16. In the illustrated example, fuel/water separator 74 is configured to separate the condensed fuel/water and generally includes a condensate inlet 78, a fuel outlet 80, and a water outlet 82. As such, the fuel/water mixture supplied by condensate conduit 76 enters the separator 74 via condensate inlet 78 and is subsequently separated into fuel and water. For example, although not shown, the condensate may be directed through a multilayer filter medium of the separator 74, which separates water from the fuel and directs the water to a water accumulation chamber via a drain tube.

The separated fuel is then supplied via fuel outlet 80 and a fuel conduit 84 to another area of the vehicle such as, for example, a fuel tank or fuel supply line (not shown) to the combustion chamber 28. The separated water is supplied via water outlet 82 and a water conduit 86 to another area of the vehicle such as, for example, the vehicle fuel tank. In this way, PCV system 16 is a self-contained, closed system that recycles or reuses the condensed and separated water and fuel vapor from the blow-by gases.

With continued reference to FIG. 1, once the fuel vapor and water vapor are separated in the condenser 62, the remaining lean blow-by gases (i.e., fully or substantially removed of water/fuel) are directed via the gas outlet 70 and a second PCV line conduit 88 to the oil separator 64. At this point, the remaining blow-by gases only or substantially only contain air with oil suspended therein (e.g., an aerosol) and, in the example implementation, the oil is subsequently separated within the separator 64. The separated oil is then directed via an oil outlet 90 and an oil conduit 92 to be returned to the crankcase 32. The remaining filtered blow-by gas is then directed via an air outlet 94 and a third PCV line conduit 96 for return to the air induction system 14 and/or combustion chamber 28.

Figure 2:
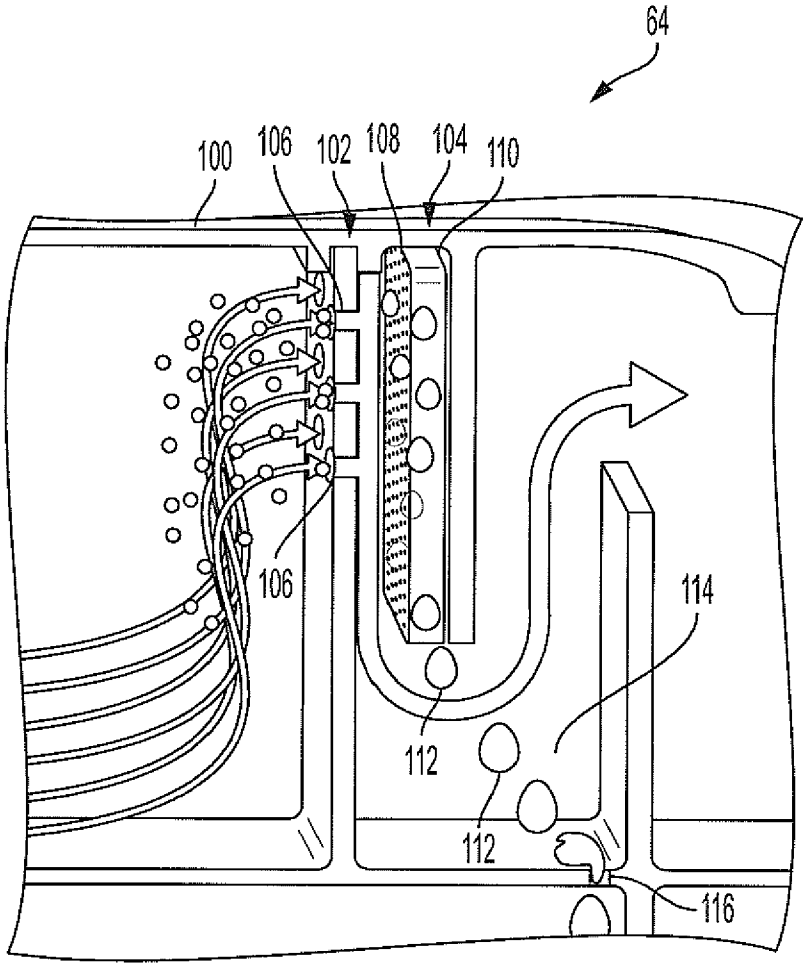
FIG. 2 is a sectional view of an example oil separator that may be used with the PCV system shown in FIG. 1, in accordance with the principles of the present disclosure.

FIG. 2 illustrates one example embodiment of the oil separator 64, which generally includes a housing 100, a nozzle plate 102, and a separator 104. In operation, the blow-by gas supplied from the condenser 62 and removed of water/fuel vapor enters the housing 100 and is forced through a plurality of holes or nozzles 106 formed through the nozzle plate 102. The converging shape of the nozzles 106 is configured to accelerate the blow-by gas, which is then forced through the separator 104, which includes a fleece media 108 and an impactor plate 110.

As the blow-by gas flows through the fleece media 108, oil droplets 112 collect on the fleece media and fall downward into an oil reservoir 114, and a drain 116 connects the reservoir 114 to the oil conduit 92 to return the separated oil to the crankcase 32. Additionally, as the blow-by gas continues through the fleece media 108 and impinges on the impactor plate 110, any residual oil droplets are collected on the impactor plate 110 and also fall into the reservoir 114 due to gravity. The resulting cleaned or filtered blow-by gas is then directed through the air outlet 94.

Figure 3:
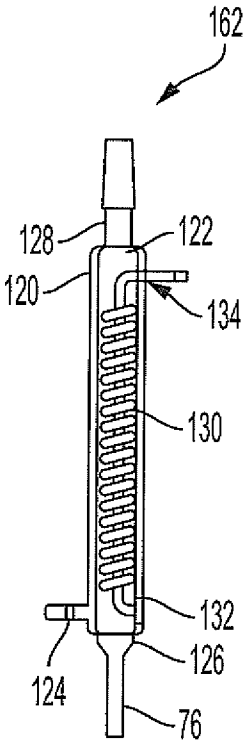
FIG. 3 is a cross-sectional view of an example condenser that may be used with the PCV system shown in FIG. 1, in accordance with the principles of the present disclosure.

FIG. 3 illustrates one example embodiment of the condenser 62 shown in FIG. 1 where the condenser is a standalone component. In the example embodiment, a condenser 162 generally includes a housing 120 defining an inner chamber 122, a blow-by gas inlet 124, a condensate outlet 126, and a blow-by gas outlet 128. In the illustrated example, a coolant tube 130 extends within the inner chamber 122 between a coolant inlet 132 and a coolant outlet 134. A coolant fluid is supplied through the tube 130 and is configured to cool the blow-by gases passing through the inner chamber 122 via indirect heat exchange. This causes the fuel vapor and water vapor contained in the blow-by gas to condense and fall toward the condensate outlet 126 due to gravity. The condensed fuel/water is then supplied to the fuel/water separator 74 via the condensate conduit 76. The remainder of the blow-by gases is directed through the blow-by gas outlet 128 and directed to the oil separator 64. In the illustrated example, the gas outlet 128 is located near a top of the housing 120 to allow maximum distance for condensing and to prevent condensate from being supplied to the oil separator 64 due to gravity.

Figure 5:
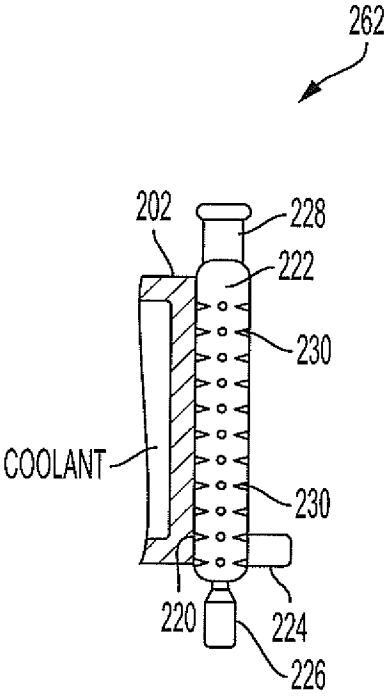
FIG. 5 is a cross-sectional view of the example condenser shown in FIG. 4, in accordance with the principles of the present disclosure.
Figure 4:
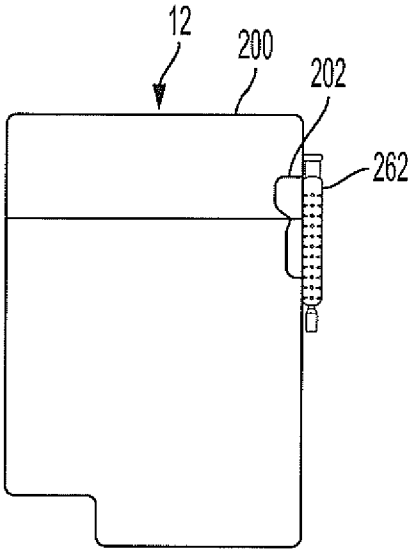
FIG. 4 is an example side view of the internal combustion engine shown in FIG. 1 with an integrated condenser, in accordance with the principles of the present disclosure.

FIGS. 4 and 5 illustrate one example embodiment of internal combustion engine 12 where a condenser 262 is integrated into the cylinder block or head casting 200, and a water jacket 202 is configured to provide cooling to a housing 220 of the condenser 262. In the example embodiment, the condenser housing 220 defines an inner chamber 222, a blow-by gas inlet 224, a condensate outlet 226, and a blow-by gas outlet 228. In the illustrated example, a plurality of fingers or protrusions 230 (e.g., with a high surface area) extend inwardly from the housing 220 into the inner chamber 222. As such, the coolant in the water jacket 202 cools the housing 220, which is integrated into the cylinder block 200, to thereby cool the protrusions 230 and the blow-by gas. Alternatively, a coil tube (not shown) similar to tube 130 can be provided in the inner chamber 222 and fluidly coupled to the water jacket 202 to provide cooling of the blow-by gas similar to that described in FIG. 3.

In the example implementation, the water jacket coolant cools the protrusions 230 via direct heat exchange, and the protrusions 230 are similarly configured to cool the blow-by gases passing through the inner chamber 222 via direct heat exchange. This causes the fuel vapor and water vapor contained in the blow-by gas to condense and fall toward the condensate outlet 226 due to gravity. The condensed fuel/water is then supplied to the fuel/water separator 74 via the condensate conduit 76. The remainder of the blow-by gases is directed through the blow-by gas outlet 228 and directed to the oil separator 64. In the illustrated example, the gas outlet 228 is located near a top of the housing 220 to allow maximum distance for condensing and to prevent condensate from being supplied to the oil separator 64 due to gravity.

Described herein are systems and methods for improving PCV system operation. The PCV system utilizes a condenser upstream of an oil separator to condense and separate fuel vapor and water vapor from crankcase blow-by gases. With the fuel/water vapor removed, the oil separator is only required to separate oil and does not have to accommodate an increased mass flow due to fuel/water vapor. Accordingly, the resulting PCV system is more efficient and can be reduced in size compared to systems that must handle the added mass flow. Moreover, the condensed and separated fuel and water mixture can be subsequently sent to a fuel/water separator and the fuel and water can then be utilized in other vehicle systems, thereby providing a closed, self-contained system.

It should be understood that the mixing and matching of features, elements and/or functions between various examples may be expressly contemplated herein so that one skilled in the art would appreciate from the present teachings that features, elements and/or functions of one example may be incorporated into another example as appropriate, unless described otherwise above.

What is claimed is:

1. A positive crankcase ventilation (PCV) system for an internal combustion engine having an air induction system configured to supply air to the engine, the PCV system comprising:

a PCV line configured to fluidly couple between a crankcase of the engine and the air induction system;

a condenser disposed on the PCV line and configured to condense water vapor and fuel vapor contained in blow-by gases received from the crankcase to separate the water vapor and fuel vapor from the blow-by gases and form a condensed water/fuel mixture and a lean blow-by gas with suspended oil, the condenser having a condensate outlet to receive the condensed water/fuel mixture, and a gas outlet to receive the lean blow-by gas with suspended oil; and an oil separator disposed on the PCV line and configured to receive the lean blow-by gas from the condenser and separate oil therefrom to form a filtered blow-by gas for return to the air induction system.

2. The PCV system of claim 1, wherein the condenser is disposed on the PCV line upstream of the oil separator.

3. A positive crankcase ventilation (PCV) system for an internal combustion engine having an air induction system configured to supply air to the engine, the PCV system comprising:

a PCV line configured to fluidly couple between a crankcase of the engine and the air induction system;

a condenser disposed on the PCV line and configured to condense water vapor and fuel vapor contained in blow-by gases received from the crankcase to separate the water vapor and fuel vapor from the blow-by gases and form a water/fuel mixture and a lean blow-by gas;

an oil separator disposed on the PCV line and configured to receive the lean blow-by gas from the condenser and separate oil therefrom to form a filtered blow-by gas for return to the air induction system; and a fuel/water separator fluidly coupled to the condenser to receive the water/fuel mixture therefrom, the fuel/water separator configured to separate the water/fuel mixture into fuel and water.

4. The PCV system of claim 3, wherein the fuel/water separator is fluidly coupled to a vehicle fuel tank to supply the separated fuel thereto.

5. The PCV system of claim 1, wherein the condenser comprises a housing defining an inner chamber, a blow-by gas inlet, a condensate outlet, and a blow-by gas outlet.

6. The PCV system of claim 5, wherein the condenser further comprises a coolant tube configured to fluidly couple to a source of coolant, the coolant tube extending within the inner chamber between a coolant inlet and a coolant outlet, and the coolant tube configured to cool the blow-by gas in the inner chamber and condense the fuel vapor and water vapor contained in the blow-by gas in the inner chamber.

7. A positive crankcase ventilation (PCV) system for an internal combustion engine having an air induction system configured to supply air to the engine, the PCV system comprising:

a PCV line configured to fluidly couple between a crankcase of the engine and the air induction system;

a condenser disposed on the PCV line and configured to condense water vapor and fuel vapor contained in blow-by gases received from the crankcase to separate the water vapor and fuel vapor from the blow-by gases and form a water/fuel mixture and a lean blow-by gas; and an oil separator disposed on the PCV line and configured to receive the lean blow-by gas from the condenser and separate oil therefrom to form a filtered blow-by gas for return to the air induction system, wherein the condenser comprises a housing defining an inner chamber, a blow-by gas inlet, a condensate outlet, and a blow-by gas outlet, wherein the condenser is thermally coupled to a water jacket of the internal combustion engine such that coolant in the water jacket is configured to cool the condenser housing to thereby cool the inner chamber and condense the fuel vapor and water vapor contained in the blow-by gas in the inner chamber.

8. The PCV system of claim 7, wherein the condenser housing further comprises a plurality of protrusions extending inwardly from the housing into the inner chamber, the plurality of protrusions configured to be cooled by the water jacket coolant to provide a cooled surface area for condensing the fuel vapor and water vapor contained in the blow-by gas in the inner chamber.

9. The PCV system of claim 1, wherein the oil separator comprises a housing containing a nozzle plate and a separator.

10. The PCV system of claim 9, wherein the nozzle plate comprises a plurality of nozzles formed therein configured to accelerate the blow-by gas as it passes therethrough.

11. The PCV system of claim 9, wherein the separator comprises a fleece media and an impactor plate.

12. The PCV system of claim 5, wherein the condenser is thermally coupled to a water jacket of the internal combustion engine such that coolant in the water jacket is configured to cool the condenser housing to thereby cool the inner chamber and condense the fuel vapor and water vapor contained in the blow-by gas in the inner chamber;

wherein the condenser housing further comprises a plurality of protrusions extending inwardly from the housing into the inner chamber, the plurality of protrusions configured to be cooled by the water jacket coolant to provide a cooled surface area for condensing the fuel vapor and water vapor contained in the blow-by gas in the inner chamber;

wherein the oil separator comprises a housing containing a nozzle plate and a separator; and wherein the nozzle plate comprises a plurality of nozzles formed therein configured to accelerate the blow-by gas as it passes therethrough, and wherein the separator comprises a fleece media and an impactor plate.

* * * * *